United States Patent [19]

Nounen et al.

[11] 4,323,873

[45] Apr. 6, 1982

[54] FUSE

[75] Inventors: Michiyasu Nounen; Yukio Iwasaki, both of Amagasaki, Japan

[73] Assignee: Mitsubishi Denki Kabushiki Kaisha, Tokyo, Japan

[21] Appl. No.: 171,939

[22] Filed: Jul. 18, 1980

[30] Foreign Application Priority Data

Jul. 24, 1979 [JP] Japan ..... 54-102618[U]

[51] Int. Cl.[3] ..... H01H 85/20

[52] U.S. Cl. ..... 337/186; 337/248

[58] Field of Search ..... 337/158, 159, 186, 187, 337/248, 273, 276, 414, 415

[56] References Cited

U.S. PATENT DOCUMENTS

| | | | |
|---|---|---|---|
| 3,662,309 | 5/1972 | Harmon | 337/248 X |
| 4,035,753 | 7/1977 | Reeder | 337/248 X |
| 4,044,326 | 8/1977 | Rodrigues | 337/248 |

OTHER PUBLICATIONS

Japanese Laid-Open Utility Model Application No. 106632/1975.

*Primary Examiner*—George Harris

*Attorney, Agent, or Firm*—M. S. Yatsko

[57] ABSTRACT

A fuse link is formed to have an arc extinguishing chamber and a cooling chamber contiguously disposed. A sealing member is disposed between the two chambers to provide hermetical sealing of the joint formed therebetween.

3 Claims, 4 Drawing Figures

FUSE

BACKGROUND OF THE INVENTION

This invention relates to improvements in performance of a fuse such as an outdoor fuse or the like comprising separately an arc extinguishing chamber and a cooling chamber for cooling the gas emerging from the arc extinguishing chamber.

SUMMARY OF THE INVENTION

The fuse of this invention includes a housing forming an arc extinguishing chamber, first and second contacts connected by a fusible member which, upon fusing, generates an arc, means generating an arc extinguishing gas upon fusing of the fusible member, and means forming a cooling chamber disposed contiguously to the arc extinguishing chamber. A sealing member is disposed between the arc extinguishing and cooling chambers.

BRIEF DESCRIPTION OF THE DRAWINGS

Reference is now made to the description of the preferred embodiments, illustrated in the accompanying drawings in which:

FIG. 1 is a side sectional view of a conventional fuse of the type referred to;

DESCRIPTION OF THE PREFERRED EMBODIMENT

Figure 1:
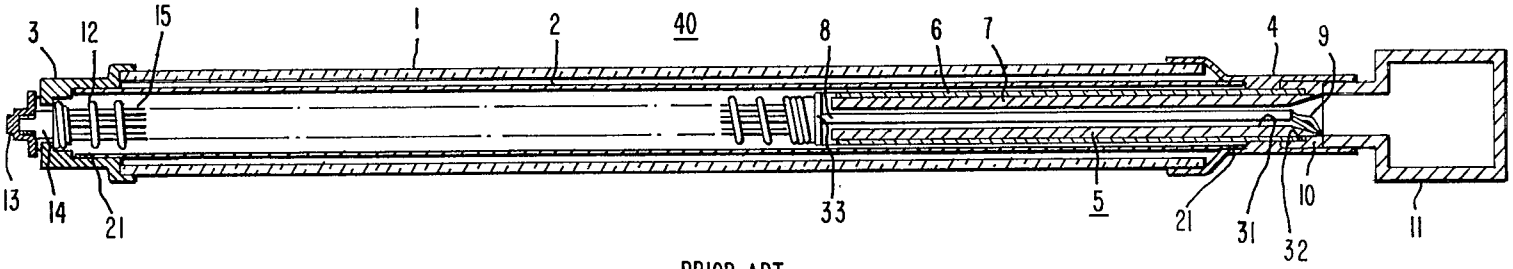
PRIOR ART FIG. 1
Figure 2:
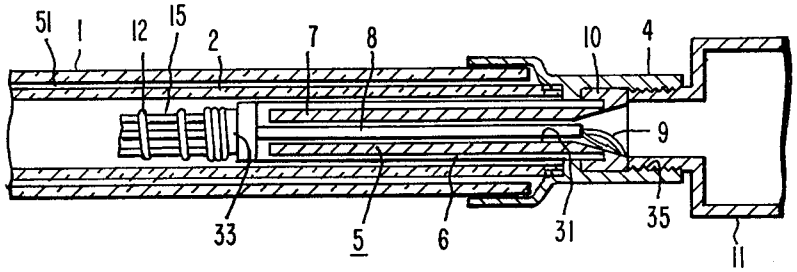
PRIOR ART FIG. 2
FIG. 2 is a side sectional view of the essential portion of FIG. 1.

FIGS. 1 and 2 show a typical example of conventional prior art fuses of the type referred to. In the figures an outer cylinder 1 for a fuse 40 consists of a porcelain tube or the like, and a vulcanized fiber tube 2, having an upper contact 3 and a lower contact 4 screw threaded into threaded portions 21 at both ends thereof, is fixed to and enclosed by the outer cylinder 1 for the fuse link through a bonding agent (not shown). A fusible element 5 is housed in the vulcanized fiber tube 2 and is composed of a circular cylindrically shaped arc extinguishing agent 7 comprised of boric acid charged into a second vulcanized fiber tube 6 so as not to form a gap with the wall surface thereof and hardened under a high pressure. A fusible member 9 is connected at one end to a tensioning rod 8 which is inserted into a central hole portion 31 of the arc extinguishing agent 7 and a metallic cap 10 is connected to the other end of fusible member 9. The cap 10 has an opening 32 on the center mounted to the vulcanized fiber tube 6. A cooling chamber 11 is screw threaded into the lower contact 4 from the inside, and a tensioning spring 12 is mounted at one end 33 to the tensioning rod 8 and at the other end to a plug 14 which is screwed to a cover 13 which in turn is mounted to the upper contact 3. The tensioning spring 12 normally urges the fusible member 9 to be pulled into the arc extinguishing agent 7. A flexible conductor 15 is disposed within the tensioning spring 12 and connects the upper contact 3 to the tensioning rod 8.

In the conventional device constructed in this way, a current flows through the upper contact 3, the flexible conductor 15, the tensioning rod 8, the fusible member 9 and the metallic cap 10 to the lower contact 4.

Now if an overcurrent flows through this fuse 40, then the fusible member 9 is fused, and the tensioning rod 8 and the arc (not shown) generated between the tensioning rod 8 and the metallic cap 10 are both pulled into the hole 31 of the arc extinguishing agent 7 by means of the force of the tensioning spring 12. Heat from that arc decomposes the arc extinguishing agent 7 to generate an arc extinguishing gas. This arc extinguishing gas, which is rapidly generated, puts the interior of the hole 31 of the arc extinguishing agent 7 under a high pressure and results in a high-speed gas stream. The gas stream flows into the cooling chamber 11 mounted to the lower contact 4 and the arc extinguishing gas is cooled therein to interrupt the arc current.

Additionally, this cooling chamber 11 has the effect of silencing the interrupting sound. In the fuse 40 after its operation, the cooling chamber 11 which is screw threaded into the lower contact 4 is removed and a fusible element 9 is replaced with a like element through that hole 35 on the lower contact 4 disposed on the side of the cooling chamber 11. It is usual that after the fuse 40 has been operated, the fusible element 9 is immediately renewed and a current again flows therethrough. However, according to circumstances, the fuse 40 may be left untouched for a few days after it has been operated. In this case, moisture may enter into the arc extinguishing chamber 51 interiorly of the cylinder 1 through the threaded portions of the cooling chamber 11 and the lower contact 4 and be absorbed by, for example, the arc extinguising agent 7, the fusible element 9 or the vulcanized fiber tube 2 such that there is the fear that the dielectric strength performance may deteriorate and the application of a high voltage may cause a repeat flashover.

Figure 3:
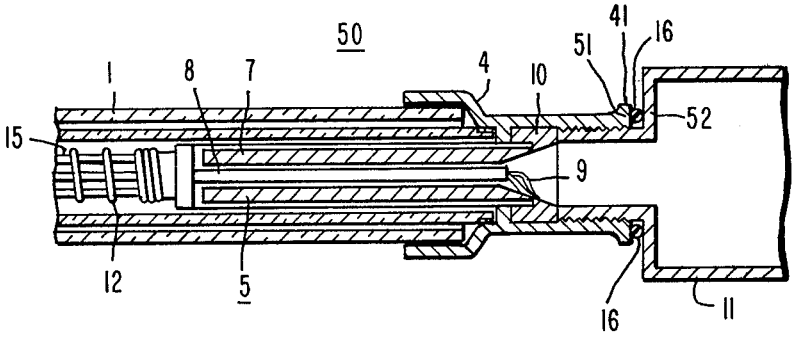
FIG. 3 is a side sectional view illustrating one embodiment of the present invention.

Referring now more particularly to FIG. 3, the fuse 50 of the present invention is illustrated. The fuse 50 is identical with the fuse 40 illustrated in FIGS. 1 and 2 and previously described, with the exception that a flange portion 41 is formed at the end 51 of the lower contact 4, and a sealing member or packing 16, such as an O-ring seal of nitrile rubber, is disposed between the flange portion 41 and a shoulder 52 of the cooling chamber 11. The operation of the fuse 50, particularly with respect to the fusible member 9, the arc extinguishing agent 7, the tensioning rod 8, and the contacts 3, 4 is as previously described.

Figure 4:
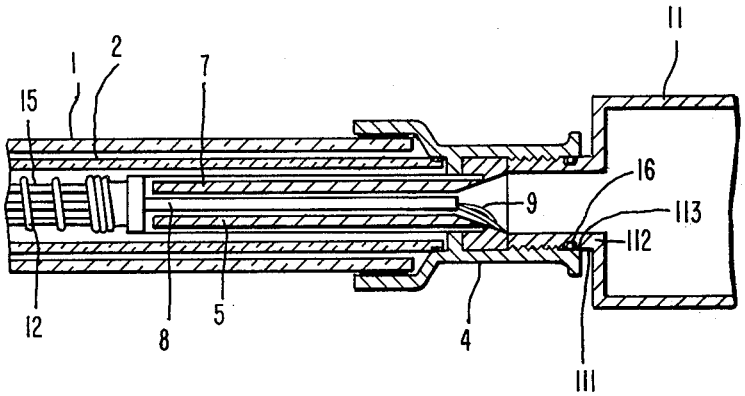
FIG. 4 is a side sectional view illustrating another embodiment of the present invention.

In a fuse 50 so constructed, the cooling chamber 11 is screw threaded into the lower contact 4 thereby to fasten the packing 16 which is crushed to a predetermined extent therebetween, whereby the joining portion of the lower contact 4 and the cooling chamber 11 can be maintained in a hermetically sealed state. Further, as shown in FIG. 4, the packing 16 may be fitted into a groove 111 disposed on that portion 112 of the cooling chamber 11 fitted into the lower contact 4 to hermetically seal the interface between the cooling chamber 11 and the inner wall 113 of the lower contact 4.

As described above, the fuse according to the present invention has a sealing member disposed between an arc extinguishing chamber disposed within an outer cylinder to extinguish an arc generated when a fusible member fuses and a cooling chamber disposed to be contiguous to that arc extinguishing chamber and to cool an arc extinguishing gas generated by means of said arc. Therefore, the fuse is hermetically sealed even after the fuse has been operated. This can provide a fuse high in reliability without hindrance to the replacement of the fusible element.

With a view to such points, the present invention has been made and provides a fuse excellent in dielectric strength performance and high in reliability by completely hermetically sealing the joining portion between the arc extinguishing chamber and the cooling chamber thereby to prevent the invasion of moisture and improve the disadvantages such as those in the prior art.

We claim as our invention:

1. A fuse comprising a hollow outer housing forming an arc extinguishing chamber interiorly thereof, said housing having a flange at one end thereof;

first and second spaced electrical contacts secured to said outer housing;

a fusible member electrically connecting said first and second contacts, said fusible member, upon fusing, causing an arc to be generated within said arc extinguishing chamber;

means for generating an arc extinguishing gas within said arc extinguishing chamber upon fusing of said fusible member;

means forming a cooling chamber disposed contiguously to said arc extinguishing chamber and cooling thereon said arc extinguishing gas, said cooling chamber means having a surface confronting said housing flange and being spaced-apart therefrom; and a sealing member disposed between said cooling chamber means confronting surface and said housing flange.

2. The fuse according to claim 1 wherein said sealing member is a packing.

3. The fuse according to claim 1 wherein said sealing member is an O-ring formed of nitrile rubber.

* * * * *